US005207329A

United States Patent [19]

Hwang

[11] Patent Number: 5,207,329

[45] Date of Patent: May 4, 1993

[54] QUICK STACKING FILING TRAYS

[76] Inventor: Shih -Ming Hwang, No. 11, Alley 12, Lane 7, Ching Tyan Street, Taiwan, Taiwan

[21] Appl. No.: 860,011

[22] Filed: Mar. 30, 1992

[51] Int. Cl.[5] ..... B65D 21/02

[52] U.S. Cl. ..... 206/555; 206/509; 206/511; 211/126

[58] Field of Search ..... 206/509, 511, 449, 555; 108/91; 211/126, 128, 153, 194

[56] References Cited

U.S. PATENT DOCUMENTS

| | | | |
|---|---|---|---|
| 2,334,825 | 11/1943 | Jones | 206/509 |
| 3,700,137 | 10/1972 | Souza | 206/511 |
| 3,918,781 | 11/1975 | Paris | 206/509 |

FOREIGN PATENT DOCUMENTS

| | | | |
|---|---|---|---|
| 0786654 | 6/1968 | Canada | 206/509 |
| 1341493 | 9/1963 | France | 211/126 |
| 1442498 | 5/1966 | France | 206/509 |
| 2023543 | 1/1980 | United Kingdom | 206/509 |
| 2231323 | 11/1990 | United Kingdom | 206/509 |

*Primary Examiner*—Jimmy G. Foster
*Attorney, Agent, or Firm*—Bacon & Thomas

[57] ABSTRACT

A filling tray is made in a rectangular shape having three side edges formed into two vertical end walls and a vertical back wall and the other side edge formed into oblique flanges and comprises two elongated grooves transversely disposed on the top thereof at two opposite ends, a plurality of ribs transversely and latitudinally formed on the bottom thereof, and two elongated rails formed on the top edges of the vertical end walls. By inserting the elongated rails of the filing tray into the elongated grooves of a similarly constructed filing tray, a plurality of filing trays of the same structure can be attached together, with one rising above or behind another, for arranging papers conveniently.

3 Claims, 2 Drawing Sheets

QUICK STACKING FILING TRAYS

BACKGROUND OF THE INVENTION

The present invention relates to filing trays and more particularly, the present invention relates to a filing tray that can be separately used, or a plurality of the boxes of the same structure can be attached together, with one disposed above another, for keeping papers in order.

Various filing trays have been known and used for keeping papers in order. However, regular filing trays are commonly of fixed type that can't be adjusted according to a desired capacity. Another disadvantage of the existing filing trays is their high manufacturing cost.

SUMMARY OF THE INVENTION

The present invention eliminates the aforesaid disadvantages. Therefore one object of the present invention is to provide a filing tray which is easy and inexpensive to manufacture. Another object of the present invention is to provide a filing tray which can be conveniently attached to other filing trays of the same structure. Still another object of the present invention is to provide a filing tray which can be conveniently attached to other filing trays of the same structure, so as to permit all the filing trays to be conveniently arranged into operation positions with one rising above another. Still another object of the present invention is to provide a filing tray which is orthopedically engineered for arranging papers conveniently.

The present invention provides a filing tray which is generally comprised of a rectangular body, which comprises two elongated grooves transversely disposed on a top edge thereof at two opposite ends and a plurality of ribs transversely and latitudinally formed on a bottom thereof, two opposite end walls rising from the bottom at two opposite ends at right angles, a back wall rising from the bottom at one the at right angles and connected between said two opposite end walls, two side flanges obliquely extending from the bottom at an opposite side and spaced by an opening, the two opposite end walls each having an elongated rail on a top edge thereof. The elongated rails of the filing tray can be respectively inserted into the elongated grooves on another filing tray of the same structure, so as to permit a plurality of filing trays of the same structure to be attached together, with one disposed above or rising behind another, for keeping papers in order.

DETAILED DESCRIPTION OF THE PREFERRED EMBODIMENT

Figure 3:
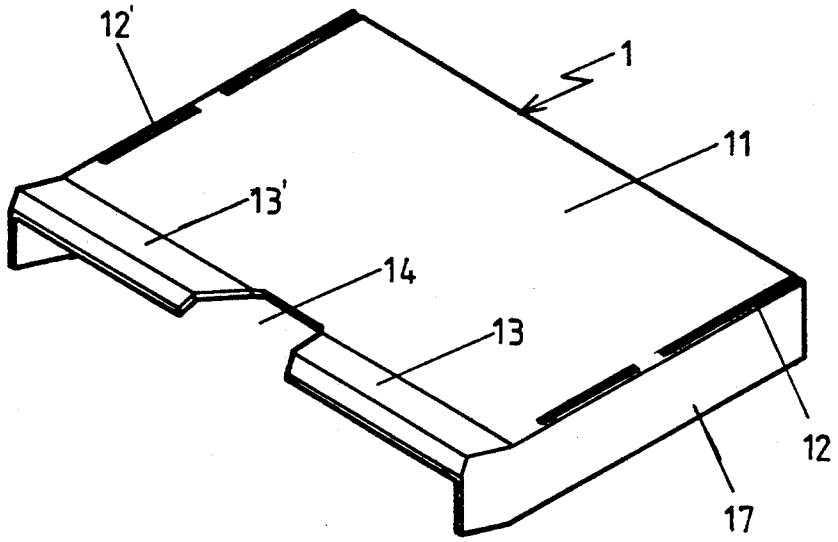
FIG. 3 is an elevational view of a single filing tray as constructed according to the present invention.
Figure 4:
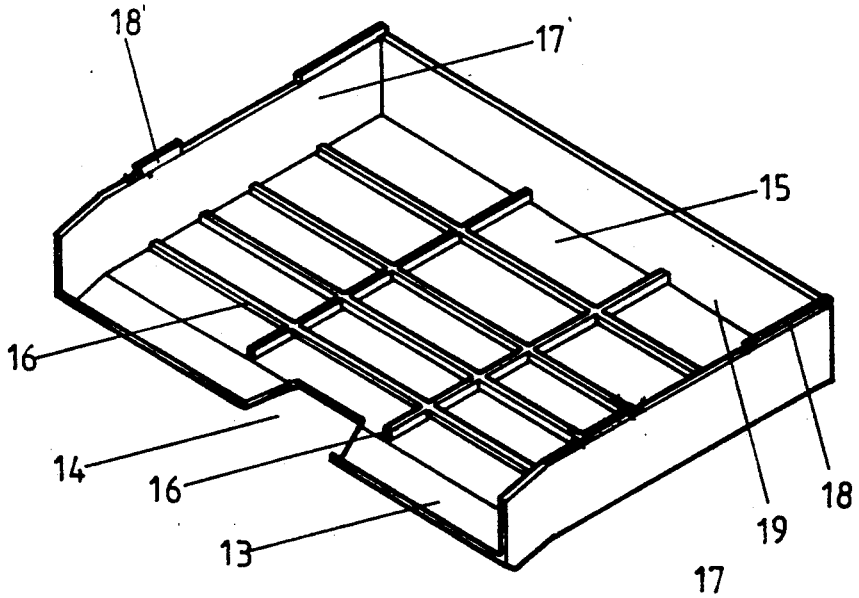
FIG. 4 is another elevational view of the filing tray of FIG. 3 when turned upside-down.

Referring to FIGS. 3 and 4, a filing tray 1 may be made from a plastic material through the process of injection molding, in a rectangular shape, comprising two elongated grooves 12' transversely disposed on the two opposite ends of the top 11 thereof, a plurality of ribs 16 transversely and latitudinally formed on the bottom 15 thereof, two opposite end walls 17 and 17' rising from the bottom 15 at two opposite ends at right angles, a back wall 19 rising from the bottom 15 at one side (namely, the back side) at right angles and connected between the two opposite end walls 17 and 17', two side flanges 13 and 13' obliquely extending from the bottom 15 at an opposite side (namely, the front side) and spaced by an opening 14, wherein the two opposite end walls 17 and 17' have elongated rails 18 and 18' on the top edges thereof. The elongated rails 18 and 18' of one filing tray 1 can be inserted in the elongated grooves 12 and 12' of another filing tray of the same structure and moved to slide therein respectively.

Figure 1:
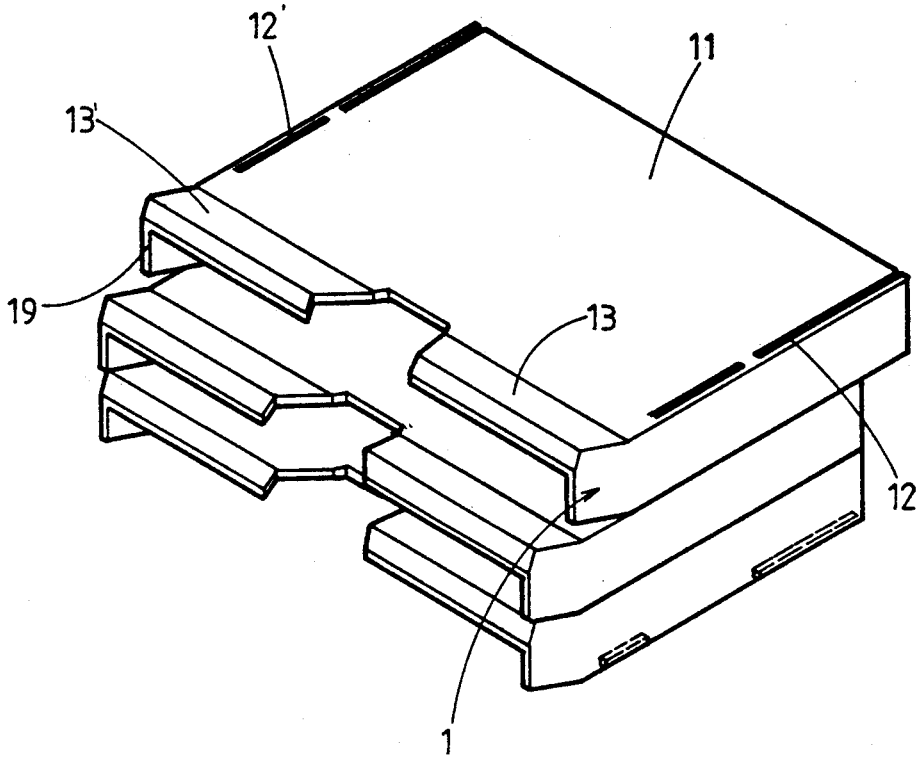
FIG. 1 is an elevational view showing that a plurality of filing trays as constructed according to the present invention, have been attached together with one disposed above another for keeping papers in order.
Figure 2:
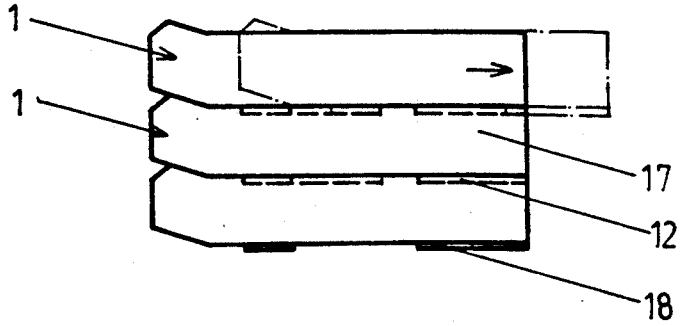
FIG. 2 is a plain side view showing that the filing trays of FIG. 1 can be relatively moved into operational positions with one rising behind another.

Referring to FIGS. 1 and 2, by inserting the elongated rails 18 and 18' of one filing tray into the elongated grooves 12 and 12' of another filing tray, a plurality of filing trays can be attached together with one disposed above another. By moving the elongated rails 18 and 18' of one filing tray in the elongated grooves 12 and 12' of another filing tray, a plurality of filing trays can be arranged, with one rising behind another, for arranging papers conveniently. Through the opening 14 on each filing tray, papers can be conveniently put into either filing tray.

What is claimed is:

1. A filing tray comprising:

a substantially rectangular main body having a top surface and a bottom surface defining a plane, first and second longitudinally spaced ends, a front lateral side portion and a rear lateral side portion, said top surface being formed with first and second laterally spaced, elongated grooves adjacent each of said first and second longitudinally spaced ends, said bottom surface being integrally formed with a plurality of longitudinal and lateral ribs;

first and second end walls laterally from said first and second longitudinally spaced ends extending substantially perpendicular to said bottom surface, each of said first and second end walls including a lateral edge portion spaced from said bottom surface and being integrally formed with first and second, laterally spaced, upstanding rails;

a back wall extending longitudinally from said rear lateral side portion substantially perpendicular to said bottom surface, said longitudinal back wall being interconnected with said first and second lateral end walls; and first and second longitudinally spaced side flanges extending from said front lateral side portion oblique to the plane defined by said bottom surface of said main body, said first and second side flanges being longitudinally separated by an opening, whereby the rails of the filing tray can be respectively inserted into the elongated grooves of another filing tray constructed in the same manner so as to permit a plurality of the filing trays to be stacked together.

2. The filing tray of claim 1, wherein said elongated rails are shorter in length than said elongated grooves in order to permit relative sliding of the filing tray when stacked upon another filing tray constructed in the same manner.

3. The filing tray of claim 2, wherein each of said first elongated grooves is formed in said top surface adjacent said back wall and extends across the rear lateral side portion of said main body and each of said first elongated rails on said end walls extends to a rearmost portion of its respective said end wall such that when the filing tray is stacked upon another filing tray constructed in the same manner, the filing tray can be shifted rearward beyond a back wall of the other filing tray with at least a portion of each of said elongated rails extending into a respective elongated groove.

* * * * *